United States Patent [19]

Phelan et al.

[11] Patent Number: 5,000,484

[45] Date of Patent: Mar. 19, 1991

[54] IDENTIFICATION AND MONITORING SYSTEM FOR SURGICAL SPECIMENS

[76] Inventors: James C. Phelan, 204 Shadow Lake Dr., Lilburn, Ga. 30247; Albert A. Clairmont, 2711 Irvin Way, Decatur, Ga. 30030

[21] Appl. No.: 400,335

[22] Filed: Aug. 30, 1989

[51] Int. Cl.[5] ..... B42D 15/00

[52] U.S. Cl. ..... 283/75; 283/74; 283/81; 283/900

[58] Field of Search ..... 283/70, 67, 74, 75, 283/81, 900; 40/309, 310, 360, 357

[56] References Cited

U.S. PATENT DOCUMENTS

| | | | |
|---|---|---|---|
| 1,750,192 | 3/1930 | Pendergast | 283/74 |
| 4,271,223 | 6/1981 | Lambert et al. | 283/81 |
| 4,327,512 | 4/1982 | Oliver | 283/900 |
| 4,587,158 | 5/1986 | Ewing | 283/81 |

*Primary Examiner*—Hien H. Phan
*Assistant Examiner*—Hwei-Siu Payer
*Attorney, Agent, or Firm*—Eric P. Schellin

[57] ABSTRACT

An identification tag is physically associated with a surgical specimen for accurate identification of the specimen. The tag remains in place through the laboratory to allow accurate identification of specimen and patient. The tag has a hole to receive a staple for stapling to solid tissue, and is flexible to be rolled and inserted into a vial with a liquid specimen or a semi-fluid specimen. The tags are prepared in advance of surgery and are available for rapid association with specimens in the operating room.

3 Claims, 1 Drawing Sheet

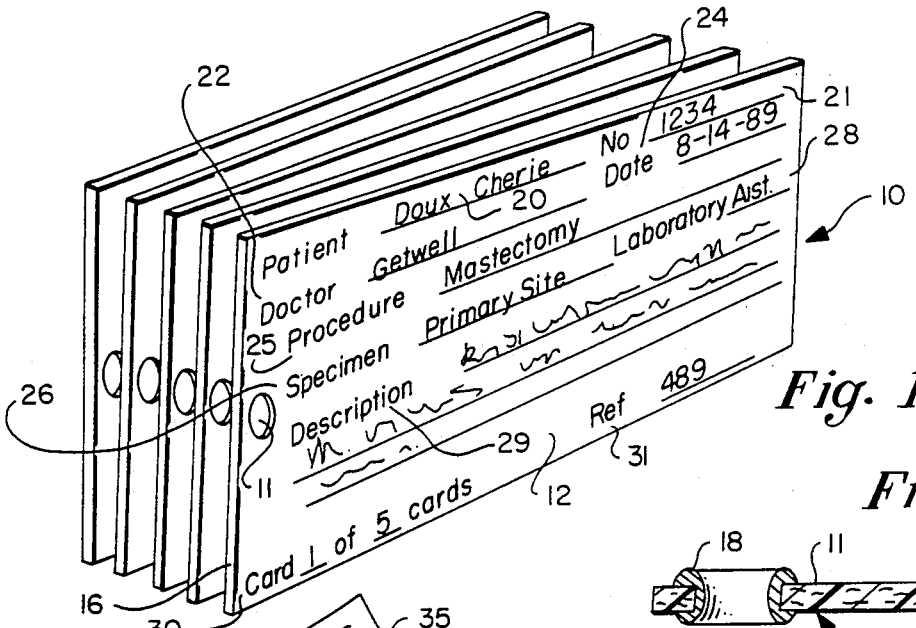
Fig. 1
Fig. 2
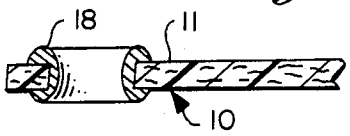
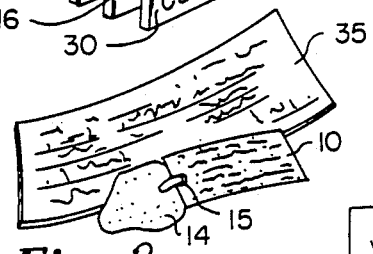
Fig. 3
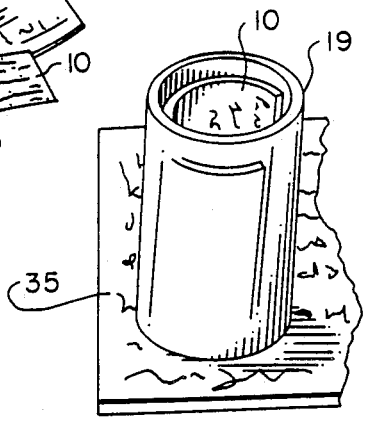
Fig. 4
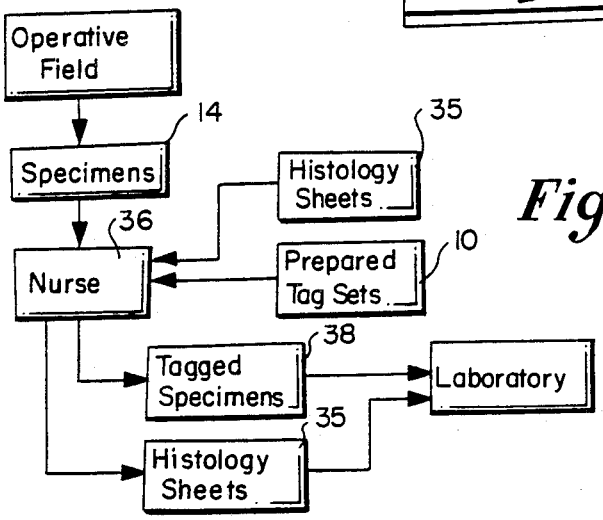
Fig. 5

IDENTIFICATION AND MONITORING SYSTEM FOR SURGICAL SPECIMENS

INFORMATION DISCLOSURE STATEMENT

During surgical procedures, it is common to take specimens from the patient, the specimens being subsequently analyzed to assist in proper diagnosis, confirmation of past diagnosis or prognosis. In the event the surgeon is attempting the excision of cancerous material, numerous specimens may be taken to determine the extent of the cancerous growth, and to be reasonably sure all cancerous material has been removed. It will be understood that proper identification of the specimens can be of the utmost importance. Obviously, the proper patient must be identified; further, the location from which the specimen was taken is important in making an accurate diagnosis, and a proper prognosis.

The prior art specimen identification system utilizes histology sheets. These histology sheets usually comprise multiple part forms that include information such as patient identification, doctor identification, procedure, date, and tests to be performed. In the operating room, a nurse will usually receive the specimens from the surgeon and prepare the specimens for the laboratory. Once the specimens are placed in appropriate containers, the histology sheets must remain in physical conjunction with the container, because identifying material is on the histology sheet and not elsewhere.

It must be remembered that the classification of the specimens must be done quickly because the surgeon does not wish to halt the procedure to identify previously taken specimens. This breaks the concentration of the surgeon and causes delay in the procedure. Nevertheless, failure to identify a specimen fully can cause that specimen to be useless. Erroneous identification may result in a false negative report to one patient and a false positive to another. As a result, it will be seen that the prior art does not include an adequate system for identifying and monitoring surgical specimens from the time of taking the specimen until the time of a report to the patient.

SUMMARY OF THE INVENTION

This invention relates generally to a method and apparatus for identifying specimens, and is more particularly concerned with a method and apparatus for identifying specimens taken during a surgical procedure and for monitoring the specimens through the laboratory analysis and report.

The present invention provides an identification device wherein the identification device carries all required information to identify a specimen as to patient, location, procedure and the like. The identification device is constructed to be directly attached to or otherwise physically associated with the specimen. For example, in the case of tissue or other solid substance, the identification device can be stapled or similarly affixed to the specimen; and, in the case of a fluid, or semi-fluid specimen, the identification device can be inserted into the same container as the specimen.

The identification device of the present invention is constructed of a material that will receive the usual identification stamps used in hospitals and the like, and can receive handwritten material, by ball-point pens and other writing instruments. The material must be sufficiently stiff to allow the device to be written on when lying against relatively soft backgrounds, such as the operative site, and must be flexible enough to be rolled and inserted into a specimen container. Thus, a metal such as an anodized aluminum may be used, or a plastic material such as a fiber-filled polyolefins, polyesters and other similar materials. One material that works quite well and is commercially available is a paper-fiber-filled polypropylene. The identification device is preferably preprinted with certain field titles to assure that all desired information is provided, and the device further includes space for additional comments or instructions.

The method of the present invention includes the steps of preparing a plurality of identification devices by placing on the devices all information known in advance of surgery. These prepared devices are placed in the operating room for use by the nurse who will catalog the specimens. The surgeon then removes a specimen, indicates the source, and delivers the specimen to the nurse. The pre-prepared device is appropriately linked to the specimen for permanent physical association.

It is also within the scope of the present invention for the surgeon to attach the identification device to the specimen. In this event, a specimen may be tagged before being severed from the patient. In either case, the surgeon may provide additional or more specific instructions on the device.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a plurality of identification devices made in accordance with the present invention;

FIG. 2 is an enlarged, fragmentary, cross-sectional view showing a modified form of the device illustrated in FIG. 1;

FIG. 3 is a perspective view on a reduced scale showing a specimen having an identifying device fixed thereto in accordance with the present invention;

FIG. 4 is a perspective view on a reduced scale showing a fluid specimen container having an identifying device therein in accordance with the present invention; and, FIG. 5 is a diagrammatic representation showing the method for using the device of the present invention.

DETAILED DESCRIPTION OF THE EMBODIMENTS

Referring now more particularly to the drawings, and to those embodiments of the invention here chosen by way of illustration, the device shown in FIG. 1 includes a plurality of identification devices 10. The plurality is shown in FIG. 1 to illustrate the concept that the identification devices 10 will be utilized in sets as will be discussed in more detail hereinafter. Each of the devices 10 will be substantially identical, except for the particular printed and/or written material on the device. Thus, only one of the devices 10 will be discussed in detail.

Looking at FIG. 1 in more detail, the identification device 10 comprises a generally rectangular card having a hole 11 closely adjacent to one edge thereof. The face 12 of the card 10 carries information necessary for the identification desired, and this will be discussed later.

An important feature of the present invention is that the device 10 can be physically associated with a specimen. In the event the specimen is solid tissue, the device 10 can be fixed directly to the specimen, as by a staple or other fastening means. This is illustrated in FIG. 3 where a specimen 14 is shown having an identification device 10 attached thereto by a staple 15.

Those skilled in the art will understand that there are several different sizes of surgical staples, and it is contemplated that a conventional surgical staple will be used to fix the device 10 to the specimen 14. Thus, the hole 11 should be quite close to the edge 16 so that even the smallest staple can have one leg passing through the hole 11 while the other leg passes directly into the tissue of the specimen 14.

Present surgical standards require that items used in the operative site be radiopaque. It is contemplated that the identification device 10 will have standard information or labeling printed in a metallic ink so the ink will show up in an x-ray. However, another means for rendering the device detectable by x-ray is shown in FIG. 2.

FIG. 2 is an enlarged, fragmentary cross-sectional view taken through the hole 11 of a device 10. The embodiment of FIG. 2 includes an eyelet 18 of metal in the hole 11. The eyelet 18 will be formed of stainless steel or other radiopaque material approved for surgical use. While it is not intended that one of the devices of the present invention will be implanted in a patient, the materials must be non-toxic to guard against damage in the event a device 10 is inadvertently implanted.

Attention is next directed to FIG. 4 of the drawings. FIG. 4 shows a container 19 having an identification device 10 partially rolled and placed therein. Those skilled in the art will understand that the container 19 is by way of illustration only, and the device 10 can be received within virtually any container. If a sample of a liquid constitutes the specimen, the device 10 can be placed in the container (such as the container 19) holding the liquid specimen, the device 10 being actually immersed in the liquid. If the specimen is in the nature of a smear, or scraping, the device 10 can be placed into whatever container is used to maintain the integrity of the specimen.

With the above in mind, it will be understood that the device 10 must be formed of a material that meets several criteria. The material cannot be toxic, and cannot be otherwise chemically active, in order to prevent change, or other contamination, of the specimen. The material must be sufficiently flexible that the device 10 can be placed into a container such as the container 19, keeping in mind the possibility that the containers may sometimes be quite small, such as small vials for blood samples. Further, the device 10 must be sufficiently stiff to allow writing on the device with the device resting on an unstable surface. For example, the surgeon may wish to rest the device 10 on the operative site and write instructions to the laboratory. If the surgeon must leave the operative site to write instructions, the instructions will probably not be written.

To achieve all the above stated ends, the identification device 10 is preferably made of a plastic material that allows writing thereon with generally conventional writing implements. The preferred material is a polypropylene filled with paper fibers. The resulting material is substantially opaque, and is flexible enough to be rolled to fit into a small vial. Additionally, the material has sufficient stiffness that it can be written on while the device is resting on a yieldable surface such as a person's body.

Other materials that work quite well in carrying out the present invention include the polyolefins, perhaps with a textured surface and perhaps with sufficient fiber filling to achieve the desired writing surface. Other plastics such as polyesters, polycarbonates, acrylic copolymers and the like may also be used. Furthermore, it is possible to use metal devices. A generally rigid metal may provide all the above described features with the exception of the flexibility, and a thin sheet of metal will provide the flexibility also. For example, a thin sheet of aluminum may have a textured surface that allows writing thereon, and the sheet can be thin and malleable enough to allow appropriate rolling or folding as may be needed.

With the above guidelines, those skilled in the art will readily select various materials that perform satisfactorily for carrying out the present invention.

Looking now at the face 12 of the identification device 10, it will be noted that there are several informational fields, each field being labeled appropriately to remind a person to provide certain information. For example, there is a field 20 labeled "Patient" followed by a field 21 labeled "No." Hospitals conventionally create records using a patient name, and a unique number for that patient. The device 10 therefore has fields for this information.

Next, the doctor's name is in a field 22, with the date of the operation at 24. The procedure to be performed is at 25; then, the particular specimen and the laboratory to receive the specimen are noted at 26 and 28. A "Description" label is at 29, followed by space for the surgeon to make whatever notes and comments he feels are necessary.

Finally, the device may include internal controls such as the label 30 indicating the card number, and the number of cards in the set. Also, a "Reference" number may be provided, e.g. for cross-reference. The "Reference" number may relate the device 10 to the histology slip 35 or other internal paperwork.

It is contemplated that the standard information such as patient name and number and doctor name will be inserted by conventional stencil equipment used in many hospitals. Nevertheless, the fields can equally well be filled in by hand where other equipment is not available.

With the above description in mind, the method for using the device should be understandable. Attention is directed to FIG. 5 of the drawings for the following.

As was mentioned briefly above, many hospitals use a histology sheet 35 which contains patient information as well as some information about a particular procedure and a particular doctor. These histology sheets are needed for the present records of many hospitals; and, the present invention allows continued use of these histology sheets but adds labeling to prevent problems. Thus, the histology sheets 35 will be preprinted as usual and delivered to the nurse 36 or other person who will be identifying specimens in the operating room. The difference with the present invention is that the nurse 36 will also receive one or more sets of identifying devices 10.

An important feature of the device 10 is that, for most operations, the surgeon will know in advance what specimens will be taken, and the location of those specimens. As a result, the devices 10 can be filled out with all information, perhaps with the exception of some comments by the surgeon.

During the operation, as the surgeon removes specimens from the patient, the specimens 14 are handed back to the nurse 36. Though the nurse 36 must label and identify all specimens as before, the nurse 36 has devices 10 already filled out so the time required to label each specimen is much reduced. Furthermore, each specimen 14 will have a device physically fixed to the specimen or otherwise physically associated with the specimen. As a result, the tagged specimens designated at 38 are passed along, and each specimen is fully identified. The histology sheets 35 are also passed along, but the physical association of the histology sheet and the specimen is not required since the device 10 and the histology sheet 35 are related by reference information, and the device 10 is attached to the specimen.

Both tagged specimens 38 and the histology sheets 35 will be routed to a laboratory. As is indicated at 28, the device 10 includes an indication of the proper laboratory, so proper routing is assured, with or without the histology sheet 35.

It will therefore be seen that the present invention provides a method and apparatus for identifying specimens, and for assuring that each and every specimen taken is properly identified. The identification device 10 carries all the information needed to assure that the specimen reaches the proper laboratory, that the proper tests are run, and that the results are credited to the proper patient. The system speeds the handling in the operating room to reduce errors and slow-downs. It will of course be realized by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

We claim:

1. A removed human specimen identification system for physical association with a removed human specimen to be analyzed, comprising:

A set of relatively opaque thin cards capable of being manually written upon, each of said cards being formed of a non-toxic polymeric material, each of said cards defining a hole therein adjacent to one edge of said card for receiving a fastening means therethrough, each of said cards having a face which has been preprinted with radiopaque indicia, each of said cards being sufficiently flexible whereby it may be bent into a transient roll, and each of said cards being sufficiently rigid whereby it may be manually written upon while residing on a yieldable support surface.

2. The system of claim 1 wherein the polymesic material is selected from the group consisting of fiber filled polypropylene, fiber-filled polyethylene, and polyester.

3. The system of claim 2 wherein the polymeric material consists of paper-fiber-filled polypropylene.

* * * * *